United States Patent [19]

Branum

[11] Patent Number: 4,921,141

[45] Date of Patent: May 1, 1990

[54] TWO-LAYERED HAT

[75] Inventor: William E. Branum, Irvine, Calif.

[73] Assignee: Lush Lid, Inc., Huntington Beach, Calif.

[21] Appl. No.: 808,551

[22] Filed: Dec. 13, 1985

[51] Int. Cl.[5] ..... B67D 5/62

[52] U.S. Cl. ..... 222/146.6; 222/175; 2/185 R

[58] Field of Search ..... 222/175, 146.6; 2/171.2, 175, 185 R

[56] References Cited

U.S. PATENT DOCUMENTS

| | | | |
|---|---|---|---|
| 708,913 | 9/1902 | Olson . | |
| 770,031 | 9/1904 | Werrick | 2/185 R |
| 2,468,661 | 4/1949 | Gladstone | 222/146.6 X |
| 3,070,803 | 1/1963 | Slepicka . | |
| 3,169,678 | 2/1965 | Wilkinson | 222/478 |
| 3,190,510 | 6/1965 | Gonzalez, Jr. | 222/478 |
| 3,765,031 | 10/1973 | Beresic | 2/185 |
| 4,133,055 | 1/1979 | Zebuhr | 2/411 |
| 4,138,743 | 2/1979 | Elkins | 2/171.2 |
| 4,420,097 | 12/1983 | Motsenbocker | 222/175 X |
| 4,451,935 | 6/1984 | Henschel | 2/185 |

*Primary Examiner*—Joseph J. Rolla

*Attorney, Agent, or Firm*—Stetina and Brunda

[57] ABSTRACT

A multi-layered hat is disclosed for storing a dispensable fluid therein. The hat comprises upper and lower layers of material interconnected to form a fluid retaining cavity therebetween. A discharge port and ventilation port are formed in the surface of the layers to facilitate discharge of the beverage to a fluid conduit, the other end of which may be placed in the mouth of the user. A thermal exchange unit, such as a frozen refrigerant encased in non-toxic plastic material, is disposed substantially within the cavity, and is adapted to transfer thermal energy between the refrigerant and the fluid stored in the cavity.

9 Claims, 2 Drawing Sheets

TWO-LAYERED HAT

BACKGROUND OF THE INVENTION

The present invention relates to beverage containers, and, more particularly, to a two-layered hat wherein the layers create a cavity for storing a beverage.

The present invention advantageously combines the functions of the hat and a beverage container. In the past, various constructions have been proposed for providing storage compartments in hats to accommodate small accessories usable in sports or specialized types of work. Other hats have been proposed which include fluid filled cavities adapted to serve as a liquid coolant for cooling the head and neck of the wearer. However, though such constructions may be effective for their intended purpose, they fail to provide the hat having an integral fluid cavity adapted to store and dispense a beverage for drinking.

By combining the functions of a beverage container in the hat, the wearer need not use his hands to hold the beverage. That freedom is of substantial, practical significance in various circumstances. For example, a wearer attending a sporting event or other public function, where seating and arm space are restricted, can use his hands to carry food or dispense condiments without having to balance a beverage container in a precarious position.

Also, a reader can use his hands to flip the pages of a book without having to pick up and put down the beverage container.

The invention is believed to have further advantageous application in connection with various other activities such as rafting, cycling or operating a riding mower. In addition, it is anticipated that the present invention may have significant application for handicapped individuals who might otherwise have difficulty consuming a beverage.

More recently, constructions have been proposed wherein one or more can holders are attached to a rigid plastic helmet with tubing inserted into each can. Dispensation for such construction occurs when the user sucks on the opposing end of the tubing. Such a construction suffers in various practical, as well as aesthetic regards. For example, such can holders, similar to can holders used in automobiles, do not provide any means for keeping the beverage cool as the wearer sits exposed to the sun. Additionally, such constructions require tubing leading to each separate can and a way of regulating the flow of fluid from each of the cans, with suction needed to dispense the beverage. Furthermore, only a limited degree of head movement is permitted by such devices before the cans spill their contents onto the wearer or the surrounding area. Besides these and other practical disadvantages of such can holder and helmet constructions, it is anticipated that, for personal or aesthetic reasons, many individuals do not wish to attract attention by packing bottles or cans on their heads.

Accordingly, though various individual features of the present invention have been generally utilized in prior constructions, those constructions have failed to provide a practical, beverage dispensing device having the functional and aesthetic qualities of the present invention.

SUMMARY OF THE INVENTION

A multi-layered hat is disclosed for storing a dispensable fluid therein. The hat comprises upper and lower layers of material interconnected to form a fluid retaining cavity therebetween. A discharge port and ventilation port are formed in the surface of the layers to facilitate discharge of the beverage to a fluid conduit, the other end of which may be placed in the mouth of the user. A thermal exchange unit, such as a frozen refrigerant encased in non-toxic plastic material, is disposed substantially within the cavity, and is adapted to transfer thermal energy between the refrigerant and the fluid stored in the cavity.

The thermal exchange unit may be formed to a variety of shapes that are receivable within cavity between upper and lower layers. The thermal exchange unit may contain material either hotter or cooler than the fluid within the cavity, and therefore heat or chill the fluid within the cavity. The thermal exchange unit may be formed to seal material therein, or may have an open surface portion such that encased or unencased material may be readily inserted into or removed from the interior of the termal exchange unit.

The hat may be formed to have single or multiple fluid retaining cavities. Each cavity may have a separate discharge port and the separate beverages, or other fluid, may be mixed together and dispensed through a single fluid conduit.

DETAILED DESCRIPTION OF THE PREFERRED EMBODIMENT

Figure 1:
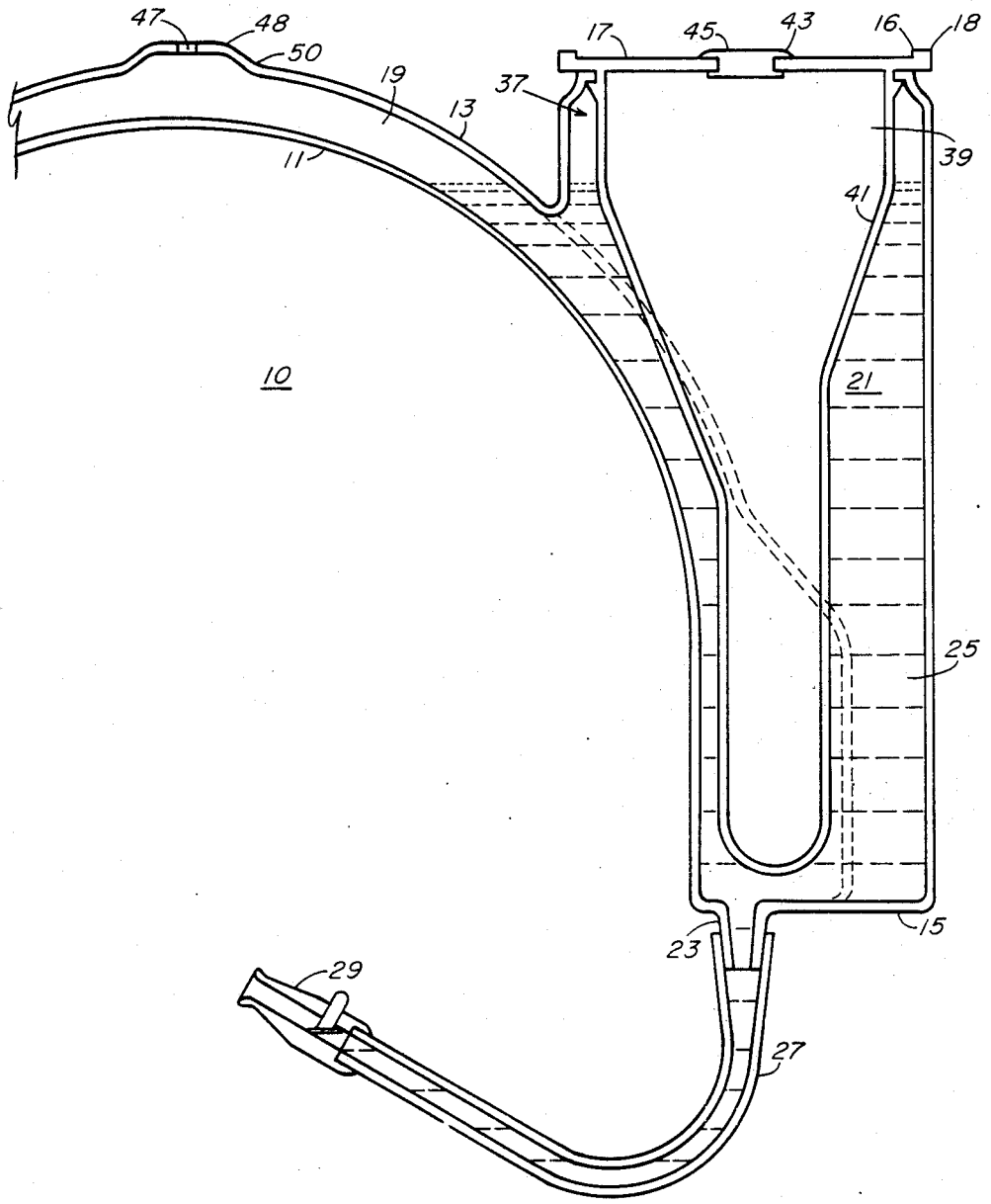
FIG. 1 is a partial frontal view of the presently preferred embodiment of the invention.

In the foregoing description, the embodiment illustrated in the drawings is intended as a description of the presently preferred embodiment of the invention, and is not intended to represent the only construction that is foreseen by the inventor. As described below , the particular arrangement of parts and materials may be modified in various respects in order to effect the mechanical, thermal and hydraulic aspects of the invention.

Figure 2:
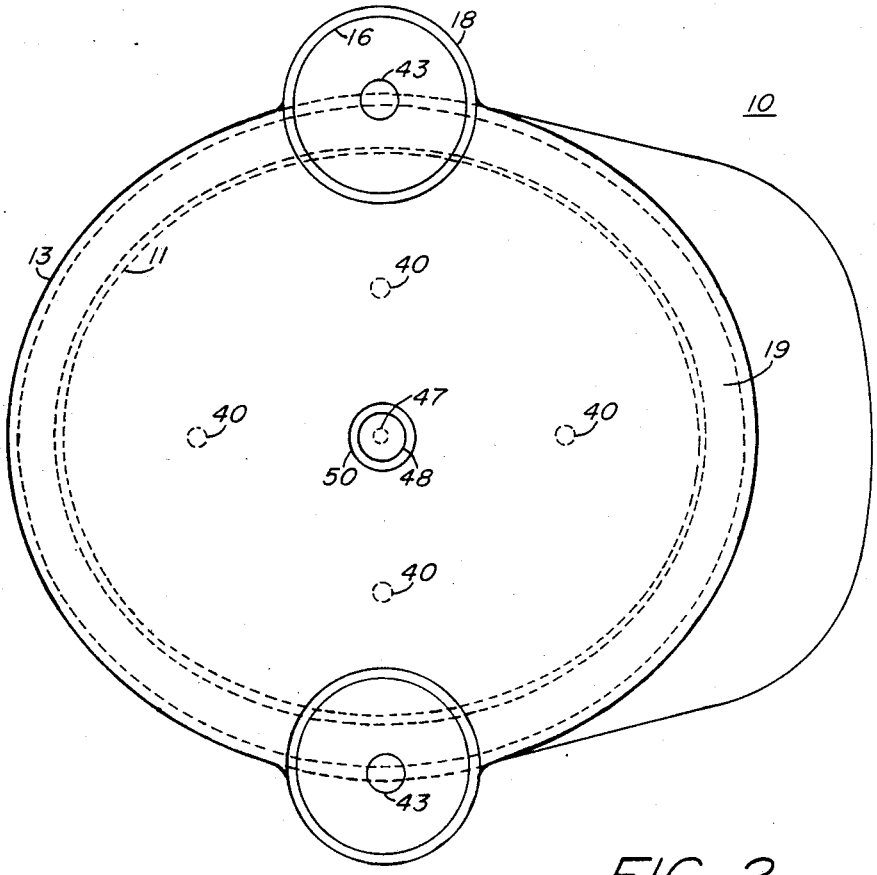
FIG. 2 is a top view of the embodiment partially illustrated at FIG. 1.
Figure 3:
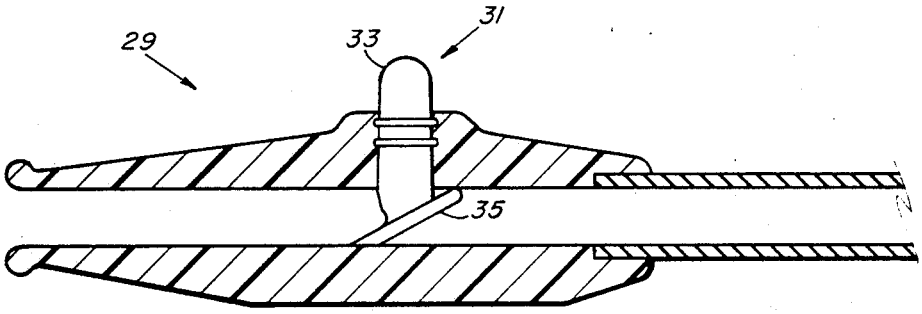
FIG. 3 is a cross-sectional view of the valve mechanism that may be used in conjunction with the present invention.

Accordingly, reference is made to the embodiment illustrated at FIGS. 1, 2 and 3, and, more particularly, to the embodiment illustrated at FIG. 1. As shown at FIG. 1, hat 10 is comprised of upper layer 13, and lower layer 11, which extend across substantially the entire area of hat 10, meeting at approximately the base 15 of hat 10. Layers 11 and 13 are joined to each other to form a fluid retaining cavity 19 therebetween, which extends substantially about the entire surface of hat 10. In one embodiment the lower surface 11 of hat 10 is provided with protrusions 40 that allow the inside of hat 10 to support matrix of fabric material to support hat 10 on the head of a wearer.

As shown at FIGS. 1 and 2, upper layer 13 is formed to include at least one substantially cylindrical aperture 17 leading to a partial cylindrical cavity or reservoir 21. Reservoir 21 is in fluid communication with and forms a part of the cavity 19 between layers 11 and 13.

In the presently preferred embodiment, the region of cavity 19 in the vicinity of aperture 17, i.e., reservoir 21, is substantially thicker than the other regions of cavity 19. In the presently preferred embodiment, the reservoir 21 comprises a substantial portion of the volume of cavity 19. It is anticipated that cavity 19 may be filled with a consumable beverage 25 through either or both of apertures 17. Beverage 25 is discharged from cavity 19 of hat 10 through discharge port 23. The discharge from port 23 is affected by the gravity flow of the beverage 25 to the lower regions of cavity 19, and continues through tubing 27 to mouthpiece 29. As is further illustrated at FIG. 3, mouthpiece 29 may be provided with a valve such as manually operated flex action valve 31, that will pass the beverage only when plunger 33 is depressed, moving blockage 35 so that beverage may pass through the mouthpiece 29 for drinking. Vent 47 is provided at an upper portion of layer 13 to facilitate the discharge of beverage 25 through the discharge port 23.

Referring again to FIG. 1, thermal transfer unit 37 is disposed within reservoir 21 and serves to transfer thermal energy between the beverage 25 and portions of unit 37, such as substance 39 within the outer casing 41 of thermal transfer unit 37. In practice, thermal transfer unit 37 may be formed of molded plastic material 41 encasing a volume of refrigerant 39 chilled to freezing. The plastic casing 41 and the refrigerant 39 may be any of a number of materials. The thermal transfer unit 37 may be similar to any of a number of commercially available packaged refrigerants such as those marketed under the trademark BLUE ICE, with the outer surface 41 being formed of non-toxic material, e.g., various types of plastics that will not impart hazardous materials into the beverage that may endanger the health of the user.

As indicated above, there are various modifications of the preferred embodiment that may be affected within the scope of the invention. Unit 37 may be formed of various shapes, as may be cavity 19. Unit 37 may further be formed of various types of materials that are either flexible or not flexible, so long as the substance within casing 41 may effectively transfer thermal energy to or from the beverage 25.

Though the presently preferred embodiment anticipates that the material 39 within unit 37 will be at least as cold as the beverage 25, it is anticipated that unit 37 may contain materials substantially warmer than beverage 25, so as to heat or keep the beverage 25 hot, rather than cool the beverage.

In the embodiment shown at FIG. 1, cap 43 is adapted for fluid tight engagement with the aperture 17 and is an integral portion of thermal transfer unit 37. However, it is anticipated that, in another embodiment, cap 43 may be formed separate from thermal transfer unit 37. In accordance with other anticipated embodiments, casing 41 may be adapted for ready removal from reservoir 21, or may be more permanently secured to layer 13, with an open upper portion adapted to receive ice cubes or various other types of disposable or non-disposable refrigerant products within the casing 41. Cap 43 may also be provided with ring 45 to facilitate removal of the cap and the unit 37, or with one or more vents to accommodate expansion and contraction of the material therein.

It is further anticipated that cavity 19 may be divided into a plurality of separate fluid retaining cavities that may, or may not, be connected to a common discharge port. In one such embodiment it is anticipated that a plurality of cavities may lead to separate discharge ports leading to separate fluid conduits to one or more mouthpieces. In another embodiment, the fluids in the separate cavities may be mixed, according to a regulated mixture, within or adjacent the hat 10, to dispense fluid through a single fluid conduit leading to the mouthpiece.

These and other variations and modifications which may be apparent to one of ordinary skill in the art may be implemented without departing from the spirit and scope of the invention.

What is claimed is:

1. A multiple-layered hat for storing a dispensable fluid therein comprising:

upper and lower layers of material innerconnected to form a fluid retaining cavity therebetween;

a discharge port formed in the surface of at least one of said layers;

at least one ventilation port formed in the surface of one of said layers to facilitate discharge of fluid through said discharge port directly into the mouth of a person using the hat without the need to remove the hat from the user's head; and a thermal exchange unit disposed substantially within said cavity, said thermal exchange unit comprising a substance having a temperature different than that of the beverage, such that thermal energy is transferred between said substance and fluid within said cavity, said thermal exchange unit being shaped to a form retractably disposable within said cavity.

2. The hat as recited in claim 1 wherein said thermal exchange unit comprises a molded plastic container having a volume of chilled refrigerant therein.

3. The hat as recited in claim 1 wherein said upper and lower layers of material form opposing surfaces of a molded, integral body.

4. The hat as recited in claim 1 wherein said thermal exchange unit comprises a sealed container having a volume of freezable refrigerant disposed therein, said container having an outer surface in contact with fluid within said cavity, said outer surface being formed of nontoxic material.

5. The hat as recited in claim 1 wherein said upper and lower layers are formed so as to define at least one fluid reservoir therebetween.

6. The hat as recited in claim 1 wherein said thermal exchange unit further comprises an upper surface portion disposed in substantially fluid tight engagement with an aperture formed in said upper layer of material.

7. The hat as recited in claim 1 wherein said thermal exchange unit comprises a casing having an open upper portion, said casing being adapted to receive a volume of chilled material therein, said chilled material being effective to cool the fluid within said cavity.

8. The hat as recited in claim 1 further including a length of tubing and a mouthpiece, said tubing having a first end in fluid communication with said discharge port, and a second end in fluid communication with said mouthpiece.

9. The hat as recited in claim 8, further including a valve formed in said mouthpiece, said valve being effective to regulate the flow of fluid from the fluid retaining cavity through the mouthpiece.

* * * * *